United States Patent [19]

Whealton et al.

[11] Patent Number: 4,602,161

[45] Date of Patent: Jul. 22, 1986

[54] NEGATIVE ION SOURCE WITH LOW TEMPERATURE TRANSVERSE DIVERGENCE OPTICAL SYSTEM

[75] Inventors: John H. Whealton; William L. Stirling, both of Oak Ridge, Tenn.

[73] Assignee: The United States of America as represented by the United States Department of Energy, Washington, D.C.

[21] Appl. No.: 707,939

[22] Filed: Mar. 4, 1985

[51] Int. Cl.[4] ..... H01J 27/02

[52] U.S. Cl. ..... 250/423 R; 376/129; 313/362.1; 313/363.1; 315/111.81

[58] Field of Search ..... 250/423 R, 424, 427, 250/426; 376/129; 313/362.1, 363.1; 315/111.81, 111.91

[56] References Cited

U.S. PATENT DOCUMENTS 4,298,798 11/1981 Huffman ..... 250/423 R 4,531,077 7/1985 Dagenhart ..... 315/111.81

OTHER PUBLICATIONS

Leung et al, "Self-Extraction Negative Ion Source", Review of Scientific Instruments, vol. 53, No. 6, Jun. 1982, pp. 803–809.

*Primary Examiner*—Bruce C. Anderson
*Assistant Examiner*—Jack I. Berman
*Attorney, Agent, or Firm*—David E. Breeden; Stephen D. Hamel; Judson R. Hightower

[57] ABSTRACT

A negative ion source is provided which has extremely low transverse divergence as a result of a unique ion focusing system in which the focal line of an ion beam emanating from an elongated, concave converter surface is outside of the ion exit slit of the source and the path of the exiting ions. The beam source operates with a minimum ion temperature which makes possible a sharply focused (extremely low transverse divergence) ribbon like negative ion beam.

3 Claims, 1 Drawing Figure

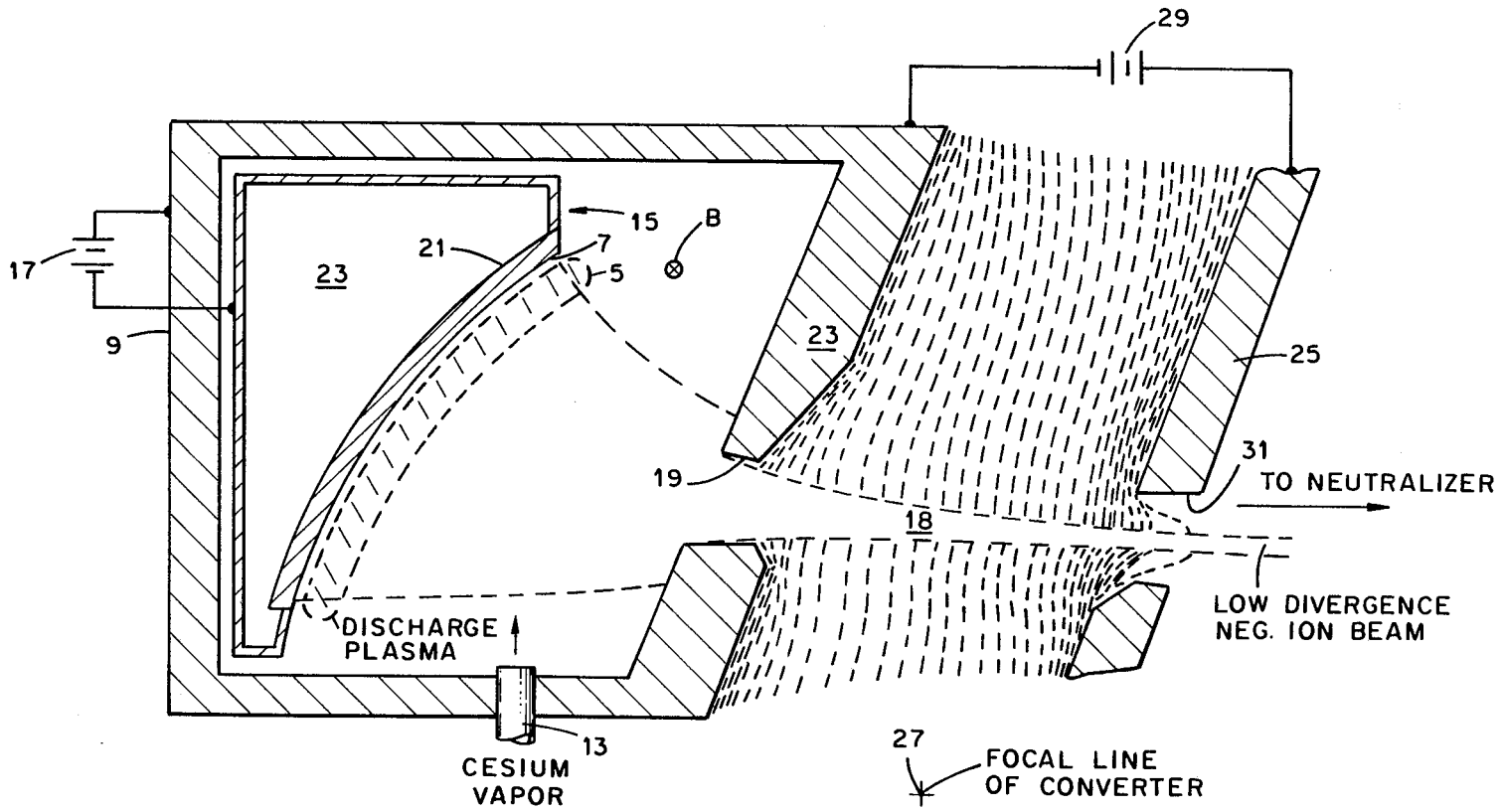
TO NEUTRALIZER
LOW DIVERGENCE NEG. ION BEAM
FOCAL LINE OF CONVERTER
CESIUM VAPOR
DISCHARGE PLASMA
B
29
25
31
27
18
23
19
15
7
5
21
13
9
17

NEGATIVE ION SOURCE WITH LOW TEMPERATURE TRANSVERSE DIVERGENCE OPTICAL SYSTEM

BACKGROUND OF THE INVENTION

This invention is a result of a contract with the U.S. Department of Energy. It relates generally to the art of negative ion sources and more specifically to improvements relating to the focusing of ion beams generated by negative ion sources.

In many plasma physics research applications, it is desirable to have a beam of negative ions with extremely low divergence. One example is in the production of energetic neutral beams for heating magnetically confined plasmas where it is desirable to obtain a beam with a divergence of less than 0.5 degrees. To produce these beams, ions from a negative ion source are accelerated into the neutralizer of a neutral beam generator. The divergence of the neutral beam is controlled primarily by the divergence of the ion beam entering the neutralizer. Thus, sharply focused beams require an ion source with very low beam divergence.

Therefore, there is a need for an improved negative ion source with low transverse divergence which may be readily adapted for the formation of negative ion beams of various species for a variety of uses.

SUMMARY OF THE INVENTION

In view of the above need it is an object of this invention to provide a negative ion source with low transverse divergence.

Other objects and many of the attendant advantages of the present invention will be obvious from the following detailed description taken in conjunction with the drawings.

In summary, the invention is an improved negative ion source of the type in which negative ions are produced in a conventional manner by surface ionization of identical species positive ions formed in an electron arc discharge plasma positioned in front of a cesiated converter surface. Positive ions from the plasma are accelerated into the converter surface due to an electrostatic potential applied between the plasma and the surface, thereby producing negative ions. These negative ions are ejected back through the discharge plasma toward an exit slit formed in an ion extraction electrode operated at a potential to extract the negative ions generated at the converter surface. This source is immersed in a magnetic field which is parallel to the converter surface for confining the positive ion plasma.

In accordance with the present invention, the converter is shaped so that it is concave in one dimension with a constant radius of curvature which is greater than the distance to the ion exit slit. The converter surface is positioned at a angle relative to the ion exit path to compensate for the magnetic field bending of the negative ion trajectories toward the exit slit. Thus, the focal line of the converter surface is out of the negative ion exit path. The focused ion beam is then accelerated electrostatically by an acceleration electrode having an opening aligned with the negative ion beam path which is operated at a positive potential relative to the ion extraction electrode and positioned therefrom to compress the negative ion beam by carefully balancing the space charge forces from the plasma and beam self interaction and providing a slight residue transverse compressing electrostatic field at the entrance to the accelerator. This ion source configuration together with the low temperature of the ions exiting the extraction electrode slit prior to acceleration produces a sharply focused negative ion ribbon with a transverse divergence of less than 0.5 degrees.

BRIEF DESCRIPTION OF THE DRAWING

The accompanying drawing, which is incorporated in and forms a part of the specification, illustrates the present invention and, together with the description, serves to explain the principles of the invention. In the single FIGURE, there is shown schematically a negative ion beam source for producing a low transverse divergence negative ion beam according to the present invention. Various parts of the source are drawn to scale to fully illustrate the relative orientation and shape to produce the highly focused negative ion beam.

DETAILED DESCRIPTION

Referring now to the FIGURE, the improved negative ion beam source is based upon a conventional gas-fed plasma generator, such as the Oak Ridge National Laboratory (ORNL) SITEX (Surface Ionization source with Transverse Extraction) details of which are provided in an ORNL publication ORNL/TM-7895, entitled Negative Ion Beam Generation with the ORNL SITEX Source, published May 1982, the contents of which are incorporated herein by reference thereto. This publication is available from the National Technical Information Service, 5285 Port Royale Road, Springfield, Va. 22161. In this type of negative ion source a plasma 5 is formed in front of a converter surface 7 by means of a hydrogen/cesium reflex discharge in the presence of a uniform magnetic field B in which the entire source is immersed. Hydrogen gas is supplied in a filament chamber (not shown) for highest gas efficiency. Cesium vapor is introduced through a conduit 13 into the source housing 9 which surrounds and together with the magnetic field B confines the plasma which is formed in a conventional manner by an electron arc discharge from a source not shown. The electrons in the discharge are confined by electrostatic potentials on the side walls of the housing 9. The plasma is formed in close proximity to the converter surface 7, typically a small fraction of a mm from the surface. This plasma consists of positive ions of a selected species, in this case hydrogen, together with cesium, produced by interaction of the electrons in the arc discharge with the gases. These ions are accelerated from the plasma into the converter surface 7 by means of a potential applied between the housing 9 and the converter surface plate assembly 15 by a 100 V dc power source 17. Negative hydrogen ions are produced through the mechanism of surface ionization with a current density of 40 mm/cm$^2$ and these negative ions 18 are ejected back through the plasma ribbon 5 to the source exit slit 19 in the front of the housing 9 forming an extraction electrode for the negative ions.

In accordance with the present invention, the converter surface 7 is formed by a curved molybdenum plate 21 of constant radius which has a nominally $\frac{3}{4}$ monolayer of cesium on the concave surface 7 thereof forming the cesiated converter surface. The plate is mounted in a water cooled base which is electrically insulated from the housing 9 by insulating mounts not shown. The converter plate 21 extends axially, perpendicular to the page and is mounted at an angle relative to the exiting negative ion beam path 18. The angle at which the converter plate is mounted depends upon the strength of the magnetic field B (typically 1300 gauss), the initial negative ion ejection velocity which is controlled by the difference in the plasma 5 and the converter 7 potential, the shape of the plasma sheath 5, and the applied electrostatic fields as manipulated by the geometry of the electrode shape. To fully illustrate this arrangement, the converter plate surface 7, the extraction electrode 23, an acceleration electrode 25 and the position of the converter surface focal line 27, which extends perpendicular to the page, are all drawn to scale. The focal line 27 corresponds to the geometric axis of the constant radius cylindrical section converter surface 7. Where the radius is 18.3 mm determining the scale of the figure for this embodiment. This configuration of electrodes and relative spacing, together with a +18 KV acceleration voltage applied to the acceleration electrode 25 by means of a dc power supply 29, produces a negative ion beam at the slit 31 in the acceleration electrode 25 having a current density of 470 $ma/cm^2$ with an RMS divergence of 0.27 degrees. The small divergence is due to electrostatic abberations produced by the electric field (constant potential lines of which are shown by broken lines in the drawing) in the region between the extraction electrode 23 and the acceleration electrode 25. The exit slit 31 is formed to produce space charge equilibrium of the beam at the exit slit 31. This highly focused beam exiting the acceleration electrode slit 31 may be used in various ways. One particular use is to introduce the beam into a neutralizer of a neutral beam generator for generating a neutral beam used to heat a magnetically confined plasma in fusion energy experiments, for example. Alternatively, the beam may be further accelerated by additional acceleration electrodes for other high energy negative ion beam applications.

Although the invention has been illustrated by means of a description of a single preferred embodiment, various modifications and variations of this invention will become apparent to those skilled in the art from the foregoing detailed description and the accompanying drawings. For example, the ion source is not limited to the production of negative hydrogen ions. Negative ions of other molecular species may be produced by the ion source. Another example is that the distance scale factor, x, may be changed provided that the potentials, $\phi$, and negative ion current density, j, are suitably changed, by keeping $jx^2$ proportional to $\phi^{3/2}$ and the magnetic field B proportional to $\sqrt{\phi}$. Such modifications and variations are intended to fall within the scope of the appended claims.

We claim:

1. In an ion source for generating a beam of negative ions from a selected molecular species wherein said selected molecular species is introduced in a gaseous state into a chamber formed by an electrically conductive housing and including a converter plate having an ion converter surface disposed within said chamber, an ion extraction electrode forming a part of said housing disposed in front of said converter plate and having an exit slit therein through which said beam of negative ions produced in said chamber exit said chamber, an acceleration electrode disposed parallel to and spaced from said extraction electrode for accelerating said negative ions passing through said exit slit of said extraction electrode through a corresponding opening in said acceleration electrode, said converter plate being operated at a first potential relative to said housing so that positive ions of said species generated in a discharge plasma column extending over and spaced from said ion converter surface are accelerated onto said converter surface to convert said positive ions to negative ions of said species by means of surface ionization and subsequently ejected from said converter surface back through said plasma column toward said exit slit in said extraction electrode and wherein said ion source is immersed in a magnetic field extending parallel to said converter surface; the improvement wherein said converter plate is in the form of a cylindrical section the inside concave surface of which forms said converter surface, said converter surface having a constant radius greater than the distance to said exit slit of said extraction electrode and wherein the focal line of said converter surface coincides with the geometric axis of said converter plate, said converter plate being disposed at an angle with respect to the direction of said beam of negative ions exiting said chamber so that said focal line is out of the path of said beam a sufficient distance to compensate for the magnetic field deflection of the negative ions ejected from said converter surface through said discharge plasma and focusing said negative ions into a beam which passes through said exit slit in said extraction electrode and wherein said acceleration electrode is positioned relative to said extraction electrode and operated at a second potential to provide said beam of negative ions in the form of a ribbon having a transverse divergence of less than 0.5 degrees.

2. The improved ion source as set forth in claim 1 wherein said extraction electrode is spaced from and aligned relative to said converter surface for passage of said negative ion beam through said exit slit thereof in accordance with a scale factor x so that $jx^2$ is proportional to $\phi^{3/2}$ and B is proportional to $\sqrt{\phi}$; where j is the negative ion current density emanating from said converter surface, $\phi$ represents the potential difference between said converter surface and said extraction electrode and B is said magnetic field.

3. The improved ion source as set forth in claim 1 wherein said converter plate is formed of a molybdenum plate having a coating of cesium on said concave surface thereof forming said converter surface.

* * * * *